United States Patent [19]

Alstad

[11] 4,249,852

[45] Feb. 10, 1981

[54] STORAGE APPARATUS

[76] Inventor: John A. Alstad, P.O. Box 418, Sunburst, Mont. 59482

[21] Appl. No.: 970,350

[22] Filed: Dec. 18, 1978

[51] Int. Cl.[3] ..... B65F 3/28

[52] U.S. Cl. ..... 414/514; 220/334; 220/335; 296/101

[58] Field of Search ..... 414/509–517; 296/100, 101; 220/334, 335

[56] References Cited

U.S. PATENT DOCUMENTS

| | | | |
|---|---|---|---|
| 2,166,846 | 7/1939 | McCalley | 414/509 |
| 2,557,003 | 6/1951 | Laurin | 414/514 X |
| 3,071,264 | 1/1963 | Totaro | 414/509 X |
| 3,211,308 | 10/1965 | Glass | 414/516 |

*Primary Examiner*—Robert G. Sheridan
*Attorney, Agent, or Firm*—Arthur L. Urban

[57] ABSTRACT

A storage apparatus including a supporting frame, a bottom portion, sidewall portions, end portions and a roof portion, the bottom, sidewall, end and roof portions forming an enclosed chamber, one of the end portions being pivotally connected to at least one of the bottom, sidewall or roof portions, the roof portion including sections pivotally connected to other sections thereof, counter-balancing means operatively connected to the pivotally connected sections of the roof portion, a movable member vertically disposed within the chamber substantially parallel to the end portions and movable therebetween, means for moving the movable member including traversing means disposed adjacent substantially the full length of the junctures of the roof portion with the sidewall portions and disposed adjacent substantially the full length of the junctures of the sidewall portions with the bottom portion, and drive means operatively connected to the movable member through the traversing means.

4 Claims, 3 Drawing Figures

STORAGE APPARATUS

This invention relates to a novel apparatus and more particularly relates to a new apparatus having a storage chamber.

Through the years, many different containers including bags, cans, boxes and the like have been used to store a wide variety of articles. Sometimes the storage is for only a short time and on other occasions for longer periods. Containers generally are selected not only for their storage capability but also for ease of filling and emptying.

While small articles can be stored easily if the quantity is not too large, problems develop as quantities and/or unit size increases. In such situations, handling can be troublesome and time consuming, and especially so when handling of the storage container must be repeated frequently.

With the great increase in the accumulation of waste in recent years, the storage, handling and disposal thereof has become a serious problem. Although the handling of waste from individual residences has changed only slightly, the handling of waste from multi-unit dwellings and commercial and industrial establishments has undergone drastic changes.

It is now common to have one or more large storage containers or bins placed around buildings to receive and store trash. Instead of emptying the trash from the container into a truck for transfer to a disposal site, the filled container is picked up with a specially equipped truck and taken to the disposal site for emptying. The empty container then is returned to its original location. This cycle is repeated periodically as the container becomes filled again.

Although such systems do reduce waste handling to a degree, they do have a number of shortcomings. For example, the containers often become full more quickly than expected. This can occur if a number of empty boxes or loose packing material is deposited in the container. Also, specially equipped trucks are required to transfer the containers to the disposal site. Furthermore, the size of the container is limited by the lifting capability of the truck and permissible overhang length beyond the truck body. In addition, the access doors are difficult to open with some container designs. Most of the waste containers are unsightly in appearance also.

The present invention provides a novel storage aparatus which is convenient to use. The access openings operate easily. The storage apparatus of the invention is aesthetically pleasing. Furthermore, the novel apparatus permits a large quantity of material to be stored per unit volume. In addition, the storage apparatus of the invention can be transferred without the use of specially equipped trucks. Also, the storage apparatus can be emptied conveniently without special equipment in a minimum of time.

The novel storage apparatus of the invention is simple in design and can be made in a variety of sizes and shapes to meet specific requirements. Moreover, the storage apparatus can be fabricated from commercially available materials and components utilizing conventional manufacturing techniques and without specially trained personnel. Further, the storage apparatus of the invention can be fabricated relatively quickly and inexpensively.

Other benefits and advantages of the novel storage apparatus of the present invention will be apparent from the following description and the accompanying drawings in which.

Figure 1:
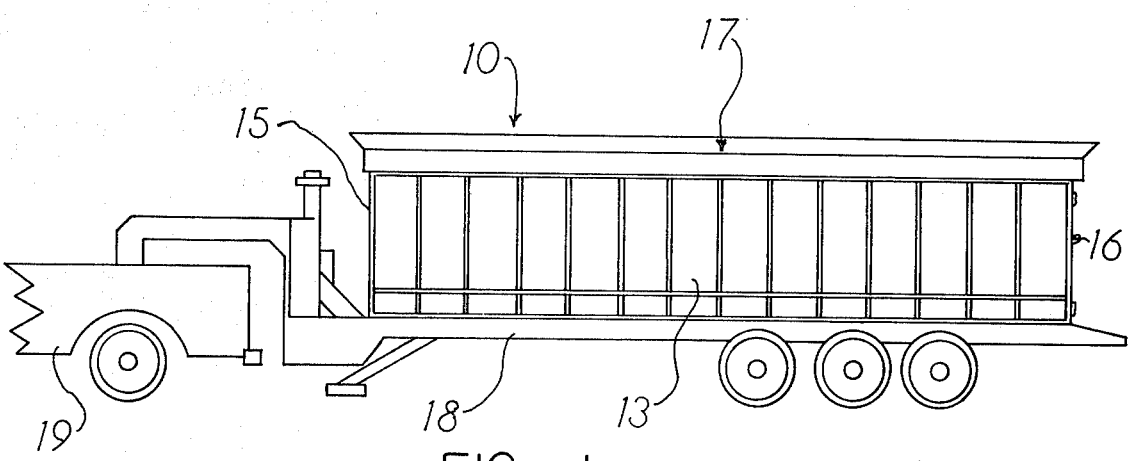
FIG. 1 is a side elevation of one form of the novel storage apparatus of the invention.
Figure 2:
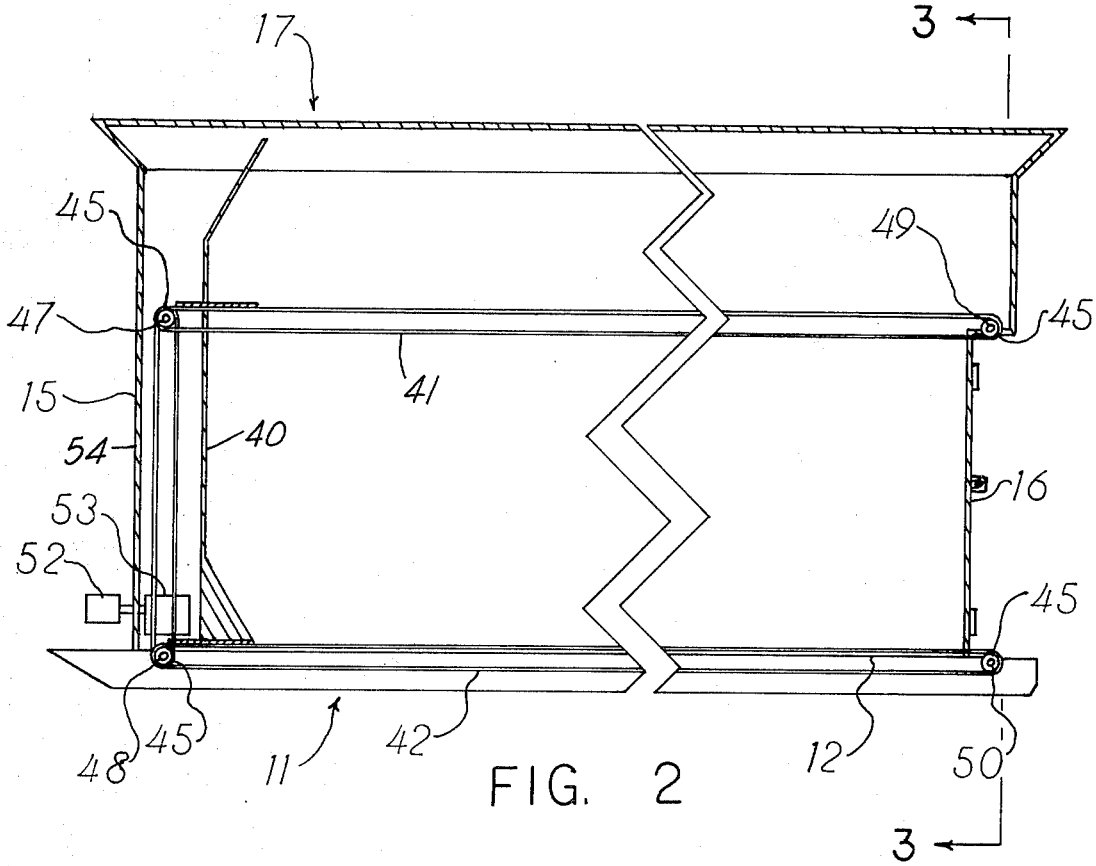
FIG. 2 is an enlarged fragmentary longitudinally sectioned side view of the storage apparatus shown in FIG. 1.
Figure 3:
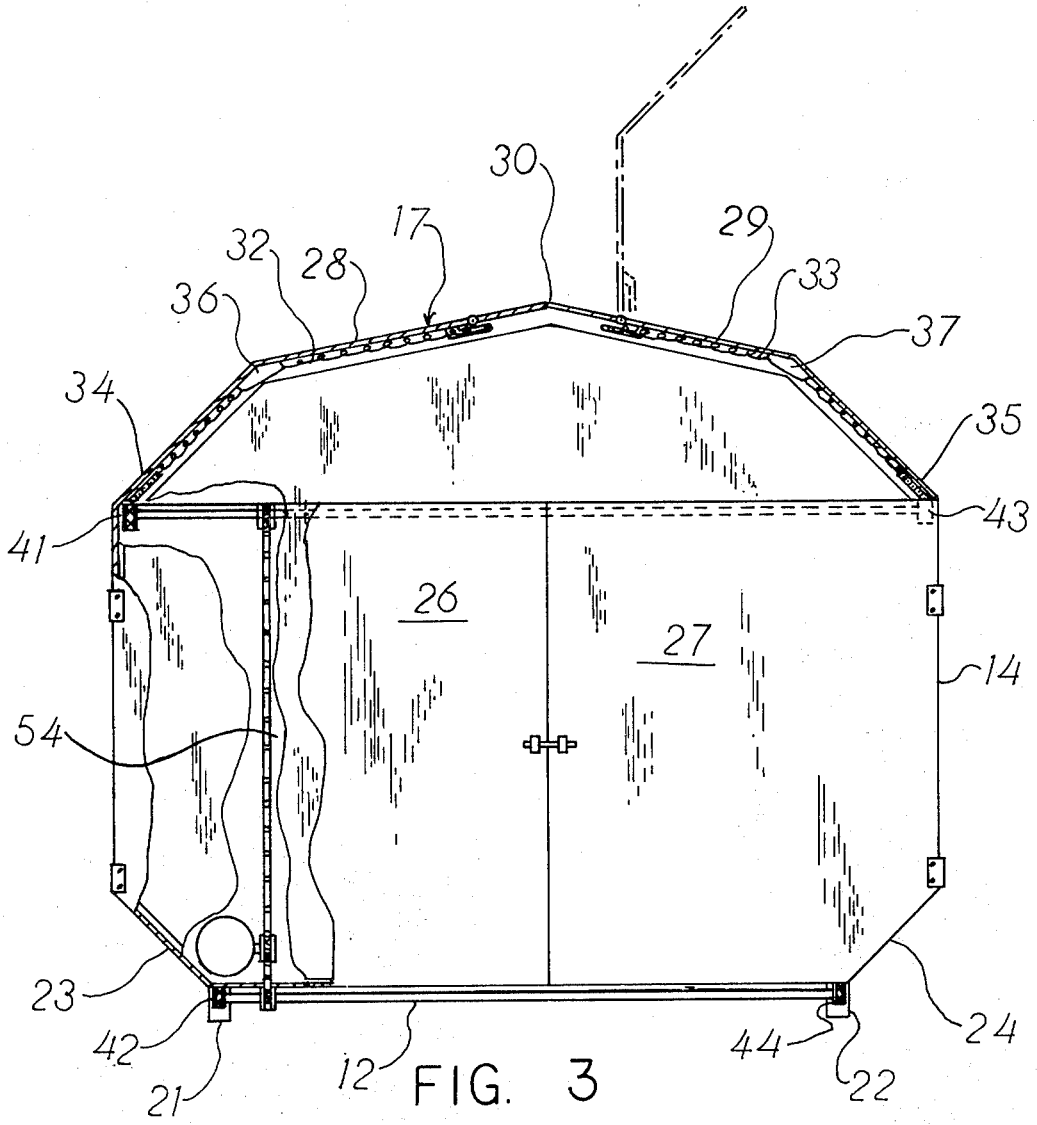
FIG. 3 is an enlarged end view in section taken along line 3—3 of FIG. 2.

As shown in the drawings, one form of the novel storage apparatus 10 of the present invention includes a supporting frame 11 and a bottom portion 12, sidewall portions 13 and 14, end portions 15 and 16 and a roof portion 17 which together form an enclosed storage chamber.

The supporting frame 11 of the storage apparatus of the invention advantageously is fabricated to enable the apparatus to be mounted on a wheeled carriage such as trailer 18 shown in FIG. 1. The storage apparatus 10 may be an integral part of the trailer or more preferably may be separable therefrom to allow one trailer in combination with a conventional truck 19 to be utilized for the transporting of a number of the storage apparatus of the invention to and from the disposal site. Supporting frame 11 advantageously includes skids 21 and 22 to facilitate loading and unloading of the storage apparatus from the trailer.

The storage apparatus of the invention as shown in the drawings has a substantially flat horizontally disposed bottom portion 12 with sidewall portions 13 and 14 extending upwardly therefrom. Preferably, the sidewall portions 13 and 14 include outwardly inclined lower sections 23 and 24 adjacent to the bottom portion 12.

One of the end portions 15 or 16 advantageously the end portion 16 at the free end of the trailer 18, is pivotally connected to at least one of the bottom portion 12, sidewall portions 13 and 14 and roof portion 17. Preferably, the pivotally connected portion includes a pair of mating sections 26 and 27 with one of the sections pivotally connected to each of the sidewall portions 13 and 14.

Roof portion 17 includes sections pivotally connected to other sections thereof. As shown in the drawings, roof portion 17 advantageously includes sections 28 and 29 inclined to each other so as to form a ridge 30. Sections 28 and 29 preferably are hinged or otherwise pivotally connected along ridge 30. This construction enables one or both of the roof sections 28 and 29 to be raised and opened at a point adjacent the top edge of the sidewall portions 13 and 14 to provide access to the chamber within the storage apparatus of the invention.

To facilitate opening of the pivotally connected sections 28 and 29 of the roof portion 17, counter-balancing means are provided. The counter-balancing means which are operatively connected to sections 28 and 29 advantageously include adjustable biasing means. As shown in the drawings, coil springs 32 and 33 are combined with turnbuckles 34 and 35 respectively to form the adjustable biasing means.

The free end of each spring 32 and 33 is attached adjacent the pivotal connection of the sections 28 and 29. Similarly, the free ends of the turnbuckles 34 and 35 are each attached adjacent the free edges of the sections 28 and 29 near the top of sidewall portions 13 and 14, respectively. Preferably, the springs 32 and 33 are threaded through guides 36 and 37 located intermediate the free edge and the pivotal connection of each section.

A movable member 40 is disposed in a generally vertical position with the storage chamber of the apparatus of the invention. The movable member 40 is disposed substantially parallel and between the end portions 15 and 16. The movable plate member 40 is movable between the end portions, that is, from one end of the storage apparatus to the other.

Means are provided for moving member 40 within the storage chamber of the apparatus. The moving means includes traversing means such as chains 41, 42, 43 and 44. As shown in the drawings, chains 41 and 43 are disposed adjacent substantially the entire length of the junctures of the roof portion 17 with the sidewall portions 13 and 14. Likewise, chains 42 and 44 are disposed adjacent substantially the full length of the junctures of the sidewall portions 13 and 14 with the bottom portion 12. In the case of chains 41 and 42, it is preferred that they be located adjacent the upper edges of the sidewall portions 13 and 14. Roller chains are especially useful.

The chains 41, 42, 43 and 44 are carried by sprockets 45 disposed on shafts 47, 48, 49 and 50 extending between the corners of the sidewall portions 13 and 14. Drive means for moving member 40 as shown includes a motor 52 and a gear reducer 53. The motor and the gear reducer are operatively connected to the chains 41, 42, 43 and 44 through an appropriate chain and sprocket arrangement 54.

In the use of the storage apparatus 10 of the invention as shown in the drawings, a truck 19 tows a trailer 18 with storage apparatus 10 thereon to a suitable location for the collection of trash. The storge apparatus 10 may be slid off the trailer 18 on skids 21 and 22 and the truck and trailer driven away. Alternatively, the storage apparatus may remain on the trailer and instead the trailer is disconnected from the truck and only the truck removed.

Trash or other waste is placed into the storage apparatus of the invention by lifting the free edge of roof section 28 or 29 away from the upper edge of sidewall portion 13 or 14, respectively. Since the roof sections are counterbalanced through springs 32 and 33, the roof sections can be lifted easily. As the storage apparatus becomes filled, motor 52 can be activated by suitable controls (not shown). Activation of motor 52 causes gear reducer 53 to drive chain and sprocket arrangement 54 which is connected to chains 41, 42, 43 and 44 through sprockets 45 carried by shafts 47, 48, 49 and 50.

The movement of the chains 41, 42, 43 and 44 causes member 40 affixed thereto to move from a point adjacent end portion 15 as shown toward the other end of the storage apparatus. This action compresses the trash within the storage chamber. The plate member 40 then is returned to its original position adjacent end portion 15 by reversing motor 52. The compression of the trash makes room in the storage chamber for the deposition of additional trash. The compression step can be repeated one or more times until the storage chamber is filled to capacity.

The storage apparatus then is emptied by taking the apparatus to a suitable disposal site. This is accomplished by driving the truck and trailer to the storage apparatus and replacing the apparatus on the trailer. The storage apparatus is transported to the disposal site and the free end of the apparatus backed into position for emptying. The doors 26 and 27 in end portion 16 are opened and motor 52 is activated. The activation of motor 52 drives gear reducer 53 and chain and sprocket arrangement 54 to advance chains 41, 42, 43 and 44. The movement of the chains causes plate member 40 affixed thereto to advance toward the open end of the storage apparatus and pushes the compressed trash from within the chamber and out of the apparatus.

The motor 52 then is reversed causing the plate member 40 to retract to the closed end of the storage chamber adjacent the end portion 15. Thereafter, the storage apparatus is returned to its collection location for the deposition of further quantities of trash.

As the storage apparatus becomes filled again, the trash is compressed as required to ensure that the chamber will be filled to its capacity. Then, the storage apparatus is returned to the disposal site for emptying again. By compressing the trash periodically as described above, the storage apparatus need be emptied much less frequently which means that the apparatus is available for the deposition of trash a greater percentage of the time. That is, there is available space in the apparatus more often and also the apparatus is at the deposition location rather in transit to and from the disposal site more of the time.

The above description and the accompanying drawings show that the present invention provides a novel storage apparatus with features not available on previous containers. Trash can be deposited therein easily since the access openings operate smoothly and with a minimum of effort. Moreover, the apparatus of the invention allows a large quantity of material to be stored per unit volume. Also, the storage apparatus can be handled with commercially available hauling equipment. In addition, the storage apparatus of the invention can be emptied conveniently without special equipment or machinery using only the normal mechanisms of the apparatus. Furthermore, the trash can be unloaded quickly without any manual labor.

The novel storage apparatus of the present invention is simple in design and can be fabricated from commercially available materials and components. Also, the conventional manufacturing techniques presently employed in industry may be utilized in the fabrication of the storage apparatus.

It will be apparent that various modifications can be made in the particular storage apparatus described above and shown in the accompanying drawings within the scope of the invention. For example, the size and configuration of the components of the apparatus may be different to meet specific requirements. Also, the exterior of the apparatus may be changed to present another appearance so that the apparatus will blend with its surroundings. Further, the movement of the compression member may be activated by different drive means as desired. Therefore, the scope of the invention is to be limited only by the following claims.

What is claimed is:

1. Storage apparatus including a supporting frame, a bottom portion, sidewall portions, end portions and a roof portion, said bottom, sidewall, end and roof portions forming an enclosed chamber, said bottom portion being substantially flat and disposed horizontally, said sidewall portions including outwardly inclined sections adjacent said bottom portion, one of said end portions including a pair of mating sections with one section pivotally connected to each of said sidewall portions, said roof portion including sections inclined toward each other to form a ridge, said sections being pivotally connected along said ridge, counterbalancing means including biasing means operatively connected to said pivotally connected sections of said roof section, a movable member vertically disposed within said chamber substantially parallel to said end portions normally disposed remote from said pivotally connected end portion and movable toward same, means for moving said movable member including roller chain means disposed adjacent substantially the full length of the junctures of said roof portion with said sidewall portions and disposed adjacent substantially the full length of the junctures of said sidewall portions with said bottom portion, and drive means including a gear reducer and a chain and sprocket combination operatively connected to said movable member through said roller chain means.

2. Storage apparatus according to claim 1 wherein said counterbalancing means includes adjustable biasing means.

3. Storage apparatus according to claim 1 wherein said supporting frame includes a skid surface.

4. Storage apparatus according to claim 1 wherein said apparatus is mountable on a wheeled carriage.

* * * * *